US005328377A

United States Patent [19]

Saito

[11] Patent Number: 5,328,377

[45] Date of Patent: Jul. 12, 1994

[54] LEVER TYPE CONNECTOR

[75] Inventor: Masashi Saito, Yokkaichi, Japan

[73] Assignee: Sumitomo Wiring Systems, Ltd., Yokkaichi, Japan

[21] Appl. No.: 78,120

[22] Filed: Jun. 18, 1993

[30] Foreign Application Priority Data

Jul. 13, 1992 [JP] Japan ..... 4-048814[U]

[51] Int. Cl.[5] ..... H01R 13/00

[52] U.S. Cl. ..... 439/157

[58] Field of Search ..... 439/152-160

[56] References Cited

U.S. PATENT DOCUMENTS 5,230,635 7/1993 Takenouchi et al. ..... 439/157

5,269,696 12/1993 Okada et al. ..... 439/157

FOREIGN PATENT DOCUMENTS 2179506 3/1987 United Kingdom .

*Primary Examiner*—Joseph H. McGlynn

*Attorney, Agent, or Firm*—Sandler, Greenblum & Bernstein

[57] ABSTRACT

A lever type connector comprising: a pair of projections, formed on each of guide grooves of a lever, which converts the rotation of the lever in a predetermined engaging direction effected due to the engagement between a pair of guide pins of a male connector and the guide grooves into the rotation thereof in a direction opposite to the predetermined engaging direction when the guide pins are brought into contact with each of the projections when the male connector is held at a temporary engaging position thereof.

3 Claims, 2 Drawing Sheets

LEVER TYPE CONNECTOR

BACKGROUND OF THE INVENTION

1. Field of the Invention

The present invention relates to a lever type connector and more particularly to the lever type connector comprising a pair of connectors connected with each other by using a lever supported by a pair of shafts projecting from one of the connectors.

2. Description of the Related Arts

A great force is required to connect a plurality of connectors, for example, 20 or more with each other. Therefore, lever type connectors have been proposed to connect them easily by means of a lever which allows an operator to connect them by applying a relatively small force thereto.

Referring to FIG. 4, an example of the above-described conventional lever type connector is described below. A lever 3 is rotatably supported by a pair of supporting shafts 4 and 4 on both outer side surfaces of a connector 1. A pair of guide pins 5 and 5 engaging guide grooves 3*c* and 3*c* of the lever 3 project from a connector 2. The lever 3 is rotated to move the connector 2 into the connector 1 so as to connect them with each other or move the connector 2 away from the connector 1 so as to disconnect them from each other due to the engagement between the guide pins 5 and 5 of the connector 2 and each of the guide grooves 3*c* and 3*c* of the connector 1.

In connecting the connectors 1 and 2 of the above-described lever type connector with each other, an operator has the connector 2 in one hand to engage the connectors 1 and 2 with each other while the operator rotates the lever 3 by the other hand. The following connector eliminates the need for using both hands in connecting them with each other. That is, an operator rotates the lever 3 by one hand with the connector 2 held by the connector 1 in a temporary engaging position. In the temporary engaging position, the connectors 1 and 2 are not in contact with each other and thus are unconductive to each other.

The above-described lever type connector has, however, the following problem in installing it on an automobile or the like: As shown in FIG. 5, in the temporary engaging position, the guide pin 5 of the connector 2 is in contact with an inclined surface 3*b* of a guide groove 3*a* formed on the lever 3. If a force F1 in the engaging direction acts on the connector 2 by accident, the guide pin 5 applies a rotational force F2 in the engaging direction to the lever 3. As a result, the lever 3 rotates in the engaging direction (A) and hence the connector 2 is moved from the temporary engaging position toward the predetermined engaging position. Consequently, the terminals of the connectors 1 and 2 are brought into contact with each other and as a result, both connectors 1 and 2 become conductive to each other although the connector 2 is not in engagement with the connector 1 at the predetermined engaging position.

If the operator has forgotten to connect the connector 2 with the connector 1 at the predetermined engaging position with the connector 2 held at the temporary engaging position, there is a possibility that an incomplete engagement between the connectors 1 and 2 cannot be detected in a conductivity inspection test, because the connectors 1 and 2 are conductive to each other.

SUMMARY OF THE INVENTION

It is an object of the present invention to provide a lever type connector, comprising a male connector and a female connector, in which the male connector can be prevented from being erroneously moved from a temporary engaging position toward a predetermined engaging position.

In accomplishing this and other objects, there is provided a lever type connector, comprising: a pair of a first connector and a second connector to be connected with each other, in which a lever is rotatably supported by a pair of supporting shafts on the first connector; a pair of guide pins which engage each of a pair of guide grooves formed on the lever project from the second connector; and the lever is rotated to move the second connector into the first connector so as to connect the first and second connectors with each other or move the second connector away from the first connector so as to disconnect the first and second connectors from each other due to the engagement between the guide pins and the guide grooves. In the above construction, there is provided a pair of projections, formed on each of the guide grooves of the lever, which converts the rotation of the lever in a predetermined engaging direction effected due to the engagement between the guide pins and the guide grooves into the rotation thereof in a direction opposite to the predetermined engaging direction when the guide pins are brought into contact with each of the projections when the male connector is held at a temporary engaging position thereof.

According to the above-described construction, if a force in the predetermined engaging direction acts by accident on the male connector disposed at the temporary engaging position, the guide pin is brought into contact with the projection formed on the guide groove of the lever supported by the shaft of the female connector. The projection converts the rotation of the lever in the predetermined engaging direction effected due to the engagement between the guide pin of the male connector and the guide groove of the lever into the rotation thereof in the direction opposite to the predetermined engaging direction. Therefore, the lever does not rotate in the predetermined engaging direction and thus the male connector held in the temporary engaging position is not moved toward the predetermined engaging position. That is, the male connector remains held at the temporary engaging position. If an operator has forgotten to rotate the lever to engage the female connector and the male connector with each other with the male connector held at the temporary engaging position thereof, it is easy to detect an incomplete engagement between the male and female connectors in a conductivity inspection test, because the terminals thereof are not in contact with each other.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
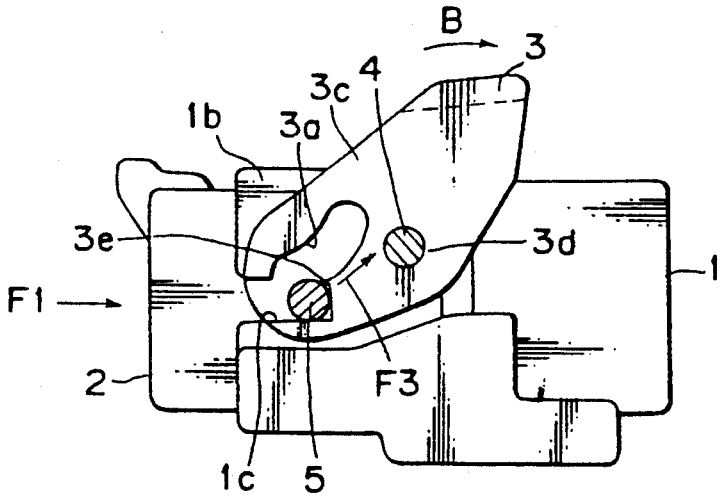
FIG. 1 is a side elevational view showing a lever type connector according to an embodiment of the present invention.

Before the description of the present invention proceeds, it is to be noted that like parts are designated by like reference numerals throughout the accompanying drawings.

Referring to the drawings, a lever type connector according to an embodiment of the present invention will be described below.

Figure 4:
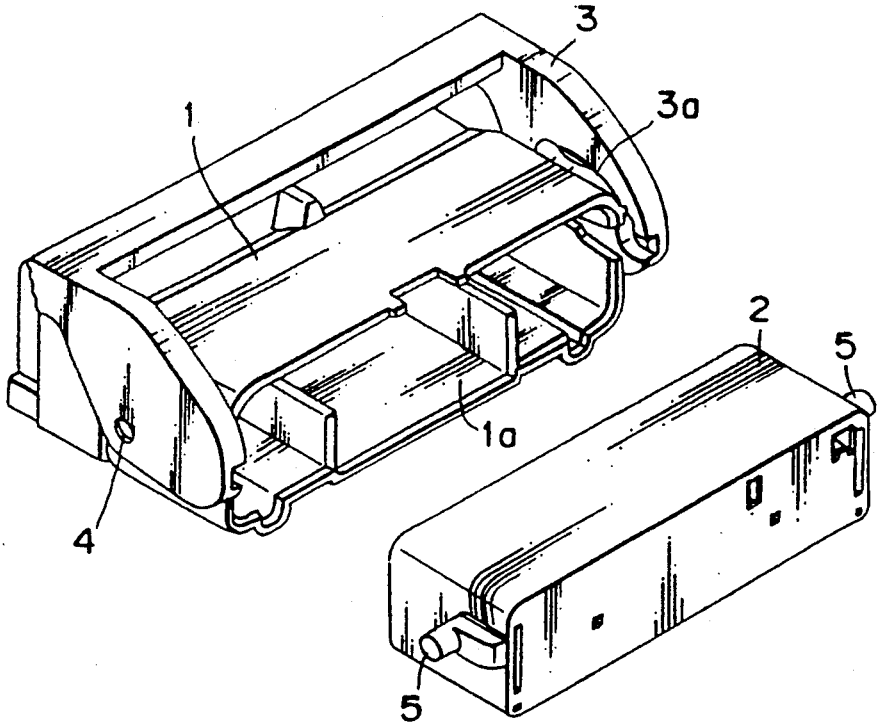
Fig. 4 PRIOR ART
FIG. 4 is a perspective view showing a conventional lever type connector.

As shown in FIG. 1, the lever type connector according to the embodiment comprises a female connector 1 on which a lever 3 has been installed. The female connector 1 is a multipolar connector having a plurality of terminal-accommodating chambers (not shown) arranged in parallel with each other. Referring to FIG. 4, a male connector 2 is inserted into the female connector 1 from an opening portion 1*a* thereof so as to connect the male connector 2 with the female connector 1.

A pair of supporting shafts 4 and 4, integral with the female connector 1, projecting outward from the outer surfaces of a pair of sides 1*b* and 1*b* of the female connector 1 is inserted into each of a pair of openings 3*d* and 3*d* formed on the sides 3*c* and 3*c* of the lever 3 so that the lever 3 is rotatably supported on the female connector 1 by means of the supporting shafts 4 and 4.

The lever 3 has on the inner surfaces of both sides 3*c* and 3*c* thereof a pair of guide grooves 3*a* and 3*a*, in a circular arc configuration, which are engaged by each of a pair of guide pins 5 and 5 of the male connector 2.

The female connector 1 has on both sides 1*b* and 1*b* thereof a pair of guide grooves 1*c* and 1*c* formed inward from the forward end of the opening portion 1*a*. The guide pins 5 and 5 of the male connector 2 engage each of the grooves 1*c* and 1*c* so that the guide pins 5 and 5 guide the male connector 2 into and out of the female connector 1 linearly.

Figure 5:
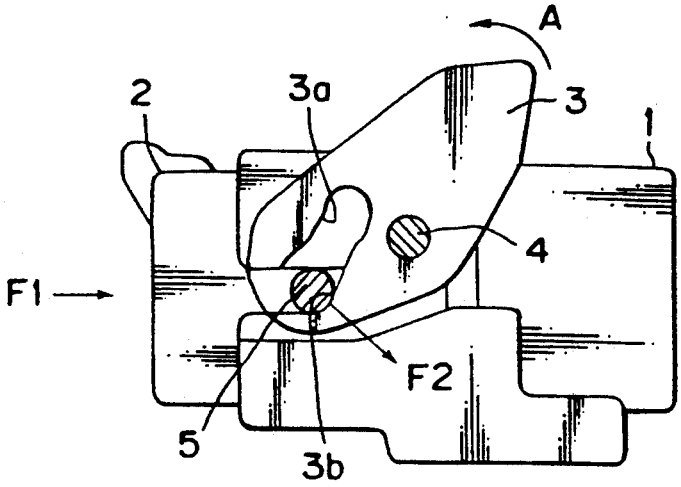
Fig. 5 PRIOR ART
FIG. 5 is a side elevational view showing the conventional lever type connector of FIG. 4.

Before the lever 3 is rotated to engage the male connector 2 and the female connector 1 with each other, the guide pins 5 and 5 of the male connector 2 are inserted into each of the guide grooves 1*c* and 1*c* of the female connector 1 from the opening portion 1*a* of the female connector 1 so as to hold the male connector 2 at a temporary engaging position (state shown in FIG. 1). At the temporary engaging position of the male connector 2, a pair of projections 3*e* and 3*e* with which the guide pins 5 and 5 are brought into contact are formed on the guide grooves 3*a* and 3*a* of the lever 3 unlike the conventional lever type connector in which the inclined surface 3*b* is formed on the guide grooves 3*a* and 3*a* as shown in FIG. 5.

Figure 2:
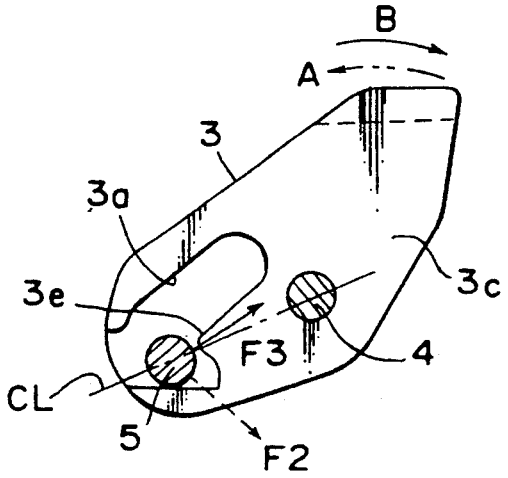
FIG. 2 is an enlarged side elevational view showing a lever of the lever type connector shown in FIG. 1.
Figure 3:
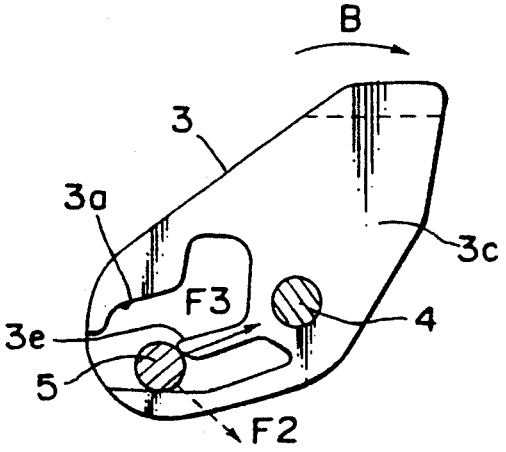
FIG. 3 is an enlarged side elevational view showing a lever according to a modification of the lever type connector of the present invention.

The projections 3*e* and 3*e* change the rotational direction of the lever 3. More specifically, the projections 3*e* and 3*e* convert the rotation of the lever 3 in a predetermined engaging direction (A) (refer to FIG. 5) which is made due to the engagement between the guide pins 5 and 5 and each of the guide grooves 3*a* and 3*a* into the rotation thereof in a direction (B) opposite to the predetermined engaging direction (A). That is, as shown in detail in FIG. 2, the projection 3*e* is disposed above a line CL formed by connecting the center of the guide pin 5 and that of the supporting shaft 4 when the guide pin 5 guided by the guide groove 1*c* of the female connector 1 is brought into contact with the projection 3*e*. According to this construction, not a rotational force F2 in the predetermined engaging direction (A) but a rotational force F3 in the direction (B) opposite to the predetermined engaging direction (A) acts on the lever 3 due to the engagement between the guide pins 5 and 5 and each of the guide grooves 3*a* and 3*a*. It is possible to form the projection 3*e* in an elongated configuration as shown in FIG. 3.

According to the above construction, let it be supposed that the force F1 in the predetermined engaging direction (A) acts on the male connector 2 by accident in the temporary engaging position in which the female connector 1 is in an incomplete engagement with the male connector 2. When the guide pin 5 is brought into contact with the projection 3*e* formed on the guide groove 3*a* of the lever 3, the projection 3*e* converts the rotational force F2 of the lever 3 in the predetermined engaging direction (A) into the rotational force F3 in the direction (B) opposite to the predetermined engaging direction (A). As a result, the lever 3 does not rotate in the predetermined engaging direction (A) and thus the male connector 2 held in the temporary engaging position is not moved in the predetermined engaging direction (A). That is, the male connector 2 remains held at the temporary engaging position.

Therefore, if an operator has forgotten to rotate the lever 3 in engaging the female connector 1 and the male connector 2 with each other, with the male connector 2 held the temporary engaging position, it is easy to detect an incomplete engagement between the connectors 1 and 2 in a conductivity inspection test, because the terminals of the connectors 1 and 2 are not in contact with each other.

When the lever 3 is rotated with the male connector 2 held at the temporary engaging position, the female connector 1 can be engaged by the male connector 2 at the predetermined engaging position due to the engagement between the guide groove 3*a* and the guide pin 5. That is, unless the lever 3 is rotated, the female connector 1 cannot be engaged by the male connector 2 at the predetermined engaging position.

Although the present invention has been fully described in connection with the preferred embodiments thereof the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A lever type connector comprising: a first connector and a second connector to be connected with each other, in which a lever is rotatably supported by a pair of supporting shafts on the first connector; a pair of guide pins which engage each of a pair of guide grooves formed on the lever, said pair of guide pins projecting from the second connector; the lever being rotated in a predetermined engaging direction to move the second connector into the first connector so as to connect the first and second connectors with each other or in a direction opposite to the predetermined engaging direction to move the second connector away from the first connector so as to disconnect the first and second connectors from each other due to the engagement between the guide pins and the guide grooves, and a pair of projections being formed on each of the guide grooves of the lever, said pair of projections converting rotation of the lever in said direction opposite to the predetermined engaging direction when the guide pins are brought into contact with each of the projections when the male connector is held at a temporary engaging position thereof.

2. A lever type connector as defined in claim 1, wherein the projection converts the rotation of the lever in said direction opposite to the predetermined engaging direction due to the engagement between the guide pins of the male connector and the guide grooves of the lever, so that the lever does not rotate in the predetermined engaging direction and thus the male connector held in the temporary engaging position is not moved toward the predetermined engaging position to thereby hold the male connector at the temporary engaging position.

3. A lever type connector as defined in claim 1, wherein each of said pair of projections is located above a line connecting the respective supporting shaft and guide pin when the guide pin is in contact with the projection.

* * * * *

UNITED STATES PATENT AND TRADEMARK OFFICE

CERTIFICATE OF CORRECTION

PATENT NO. : 5,328,377

DATED : July 12, 1994

INVENTOR(S) : M. SAITO

It is certified that error appears in the above-indentified patent and that said Letters Patent is hereby corrected as shown below:

At the cover page: section [56], line 3 under U.S. Patent Documents, insert ---5,135,410 08/04/92 KAWASE et al.---.

At the cover page: section [56], line 2 under Foreign Patent Documents, insert ---0459448 05/29/91 E.P.O.---.

Signed and Sealed this

Twenty-seventh Day of May, 1997

*Attest:*

Bruce Lehman

BRUCE LEHMAN

*Attesting Officer*

*Commissioner of Patents and Trademarks*